United States Patent [19]

Schreiber et al.

[11] Patent Number: 4,803,941

[45] Date of Patent: Feb. 14, 1989

[54] EMBROIDERY MACHINE EQUIPPED WITH THREAD GUIDE AND CLAMPING DEVICE

[75] Inventors: Max Schreiber; Armin Kobler, both of Arbon, Switzerland

[73] Assignee: Adolph Saurer AG, Arbon, Switzerland

[21] Appl. No.: 115,520

[22] Filed: Nov. 2, 1987

[30] Foreign Application Priority Data

Nov. 6, 1986 [CH] Switzerland ..... 4430/86

[51] Int. Cl.[4] ..... D05C 11/00

[52] U.S. Cl. ..... 112/83; 112/97; 112/163

[58] Field of Search ..... 112/97, 83, 87, 93, 112/96, 98, 100, 101, 78, 285, 292, 295, 302, 163

[56] References Cited

U.S. PATENT DOCUMENTS

| | | | |
|---|---|---|---|
| 1,288,369 | 12/1918 | Zenorini . | |
| 3,009,433 | 11/1961 | Kuhn | 112/97 X |
| 3,349,733 | 10/1967 | Ree | 112/83 |
| 4,535,709 | 8/1985 | Kuhnis et al. | 112/83 |

FOREIGN PATENT DOCUMENTS

| | | |
|---|---|---|
| 38620 | 8/1909 | Fed. Rep. of Germany . |
| 195048 | 1/1938 | Switzerland . |

*Primary Examiner*—Peter Nerbun

*Attorney, Agent, or Firm*—Werner W. Kleeman

[57] ABSTRACT

The embroidery machine encompasses a large number of embroidery locations equipped with displaceably guided embroidery needles for the embroidery threads. These embroidery threads partially wrap about adjacently situated, conjointly to-and-fro oscillating thread guides of a thread delivery device in order to respectively accomplish the thread advance and thread retraction. At the region of the thread guides there is arranged a thread guide and clamping device comprising adjacently mounted guide elements located in a row upon a machine-fixed holder rail. These guide elements correspond in number to the number of embroidery locations and are constructed for guiding the threads, for clamping of the threads and for the cutting of the threads. With this arrangement there can be constructed or retrofitted, respectively, an embroidery machine of the aforementioned type such that there can be simply undertaken and with a good visual overview of the embroidery machine the guiding including the threading-in of the threads into the relevant guide elements, the clamping and severing of the thread ends of threads which do not participate in the embroidery operation, in other words are at standstill, and the non-participating threads can be optimally prepared for accomplishing a subsequent color or repeat change.

16 Claims, 2 Drawing Sheets

EMBROIDERY MACHINE EQUIPPED WITH THREAD GUIDE AND CLAMPING DEVICE

BACKGROUND OF THE INVENTION

The present invention broadly relates to embroidery machines and, in particular, to a new and improved construction of an embroidery machine equipped with a novel construction of a thread guide and clamping device.

Generally speaking, the embroidery machine of the present development is of the type comprising a large number or plurality of embroidery locations arranged in at least one row and equipped with axially displaceably guided embroidery needles. The embroidery threads or yarns or the like of the embroidery needles are partially trained or wrapped about adjacently situated conjointly to-and-fro oscillating thread guides of a thread delivery device in order to accomplish the thread feed or advance and the thread retraction, as the case may be. The threads which are partially wrapped about the conjointly to-and-fro oscillating thread guides of the thread delivery device are guided over a thread brake element, such as a thread brake roll or roller.

In embroidery machines of the aforementioned type working with a large number of embroidery needles arranged in one or a number of rows all of the adjacently situated embroidery threads or the like partially wrap about the thread brake roll and the thread guides, and specifically, depending upon the repeat pattern and, in particular, in the case of multi-color embroidery operations, this is so for both the embroidering as well as also the non-embroidering threads.

In order to prevent with such arrangements the jumping over or crossover of the threads which are alternatively loosened and tightened or tensioned due to the oscillation of the thread guides, there is required a thread guide structure which laterally carefully limits or bounds the threads.

Furthermore, a multi-color embroidery operation performed upon such embroidery machines requires placing into standstill the threads which are not momentarily participating in the embroidery operation and removal or release of such non-participating threads from the fabric or cloth. In particular the thread ends then must be fixedly clamped and the excess ends must be severed or cut. Depending upon the type of embroidery machine the threads which have been placed into a standstill state or mode can remain in the needle eyelet of the associated embroidery needle in preparation for a subsequent color or rapport change or the stationary threads must be threaded-out and retracted back at least up to the region of the thread guides.

Although for the lateral thread guiding operation there were heretofore provided hooks, combs and the like, for the fixed retention of the thread ends of the stationary or non-participating threads it was conventional practice to use pins or pin members about which there was wrapped the thread and then torn off.

Neither of these proposals is adequate to comply with the present day requirements which demand a good visual overview or inspection capability for the embroidery machine, as well as effective and user-friendly servicing of such embroidery machines.

SUMMARY OF THE INVENTION

Therefore, with the foregoing in mind it is a primary object of the present invention to provide a new and improved construction of an embroidery machine of the character described which is not afflicted with the aforementioned drawbacks and limitations of the prior art constructions.

Another and more specific object of the present invention aims at the provision of a new and improved construction of an embroidery machine which is designed such that the guiding of the threads, the threading-in of the threads into the related or associated guides or guide elements, the clamping and the cutting off or severing of the thread ends of stationary threads can be accomplished in a simple and visually unobstructed manner and thus the stationary threads can be optimumly prepared for a next color or rapport change.

Yet a further significant object of the present invention is concerned with a new and improved construction of an embroidery machine equipped with thread guide and clamping devices of relatively simple construction and design, which allow for a relatively simple and efficacious guiding of the stationary threads, threading-in of such threads into the related guides or guide elements, the clamping and the severing of the thread ends of the stationary threads.

A further noteworthy object of the present invention is directed to a new and improved construction of an embroidery machine equipped with novel thread guide and clamping devices of relatively simple construction and design, which also are quite economic to manufacture, highly reliable and simple in operation, not readily subject to breakdown or malfunction, and require a minimum of maintenance and servicing.

Now in order to implement these and still further objects of the invention, which will become more readily apparent as the description proceeds, the embroidery machine of the present development is manifested by the features that at the region of the thread guides, preferably between the thread guide and clamping device composed of thread guide elements. These thread guide elements correspond in number to the number of embroidery locations or positions and are constructed for thread guiding, thread clamping and thread end severing. These thread guide elements are mounted in neighbouring or juxtapositioned relationship in a row along the embroidery machine upon a machine-fixed or stationary holder member, such as a holder rail.

According to a further aspect of the invention the guide elements are mounted at a pitch or mutual spacing from one another corresponding to the smallest spacing of the embroidery needles with respect to one another. These guide elements furthermore possess a width which is less than the mutual spacing of the embroidery needles and form between each two neighbouring or juxtapositioned guide elements a thread guide gap or slot for the laterally limited guiding of the inserted or laid-in thread or the like. Due to this design there is realized a particularly simple and effective construction of the thread guide and clamping device.

Moreover, each guide element can be provided at its one narrow side with a substantially vertically extending or vertical recess or cut-out and at its other narrow side with a nose member or nose-like protuberance. This nose member or nose-like protuberance engages into the vertical recess or cut-out of the neighbouring guide element at the upper region or section of the associated thread guide gap or slot. This effectively prevents any jumping out of the inserted or laid-in thread in an upward direction without, however, hindering or obstructing the insertion or laying-in of the tensioned or stretched thread from above into the thread guide gap or slot.

According to one advantageous design of the thread guide and clamping device each guide element is provided at its upper or top side or surface or face with a thread clamping spring or resilient element which coacts with a confronting irregular or uneven, such as a serrated clamping surface of the guide element. This results in a constructionally simple solution in order to positively and in a simple manner fixedly clamp the pulled back or retracted thread end.

If it is found that the aforementioned construction results in too low a thread tension force when working with certain threads or the like, then it is possible to resort to a slightly more complicated construction. Such entails providing each guide element at its upper end face or surface with a thread clamping plate. This clamping plate coacts with a clamping element or piece which resiliently contacts the underside of the clamping plate.

This last-mentioned construction can be designed such that each guide element is provided with a recess or depression at its upper end face or surface which receives the clamping element or piece as well as a compression or pressure spring or equivalent structure which exerts a pressing force or presses the clamping element towards or against the clamping plate. At the clamping element or piece there can be formed at its upper end surface or side an inclined rib or rib member which engages with a recess or pocket of the clamping plate. Due to this construction there is rendered possible a triple deflection of the clamped thread end, resulting in a sufficient clamping force which can be universally employed for all thread thicknesses.

Furthermore, the free end of the thread clamping spring or the thread clamping plate, as the case may be, can be bent or flexed. This bent free end of the thread clamping spring or thread clamping plate can engage with or extend into an upwardly widened section or portion of the thread guide gap or slot between two neighbouring guide elements as well as into the vertical recess for the purpose of limiting a draw-in channel for the thread. This arrangement facilitates the drawing in of the pulled back thread end.

According to a further feature of the invention there can be provided, as by performing a suitable machining or cutting operation at an outer edge of the thread clamping spring or the thread clamping plate, as the case may be, a downwardly flexed or bent projection or ramp-like or sloped structure, and the thread cutting or severing edges are effective at the thread clamping spring or thread clamping plate, as the case may be, and the projection or ramp-like or this arrangement the pulled or drawn back thread can be cut or severed at the direct region of the clamping device and thus there can be beneficially avoided the heretofore occurring tearing of the thread.

Also each guide element can be provided with a blow or blow-out groove or channel or equivalent structure which extends directly beneath the cutting edges. The provision of such blow groove or channel facilitates the elimination of any possibly occurring lint fly and thread remainders or other undesirable contaminants or the like.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings it is to be understood that only enough of the construction of the embroidery machine and related thread guide and clamping device has been depicted therein and as needed for those skilled in the art to readily understand the underlying principles and concepts of the present development while simplifying the showing of the drawings.

Figure 1:
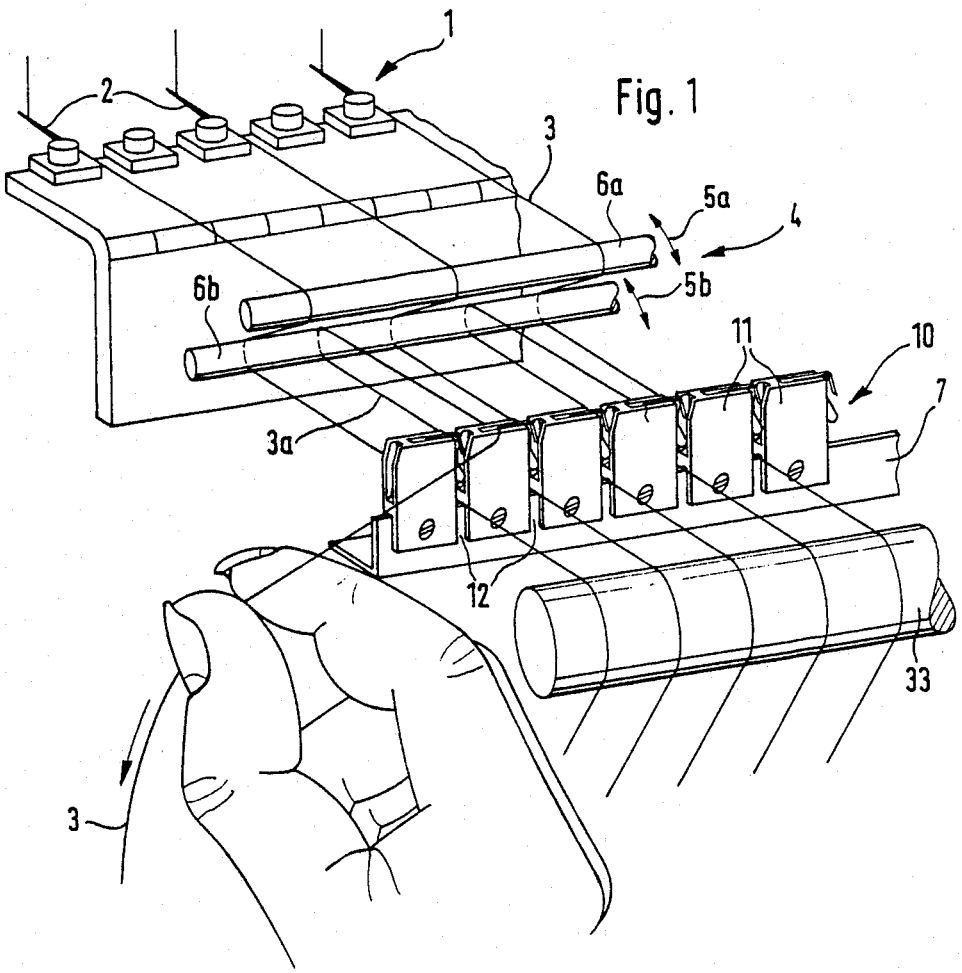
FIG. 1 is a perspective schematic partial illustration of an embroidery machine equipped with the inventive thread guide and clamping device shown at the region of the thread guides of the thread delivery device.

Turning attention now specifically to the perspective and partial illustration of an exemplary embodiment of an embroidery machine as shown in FIG. 1, it will be recognized that the same contains a large number of embroidery locations or positions 1, only a portion of which are conveniently shown, and which are depicted to be arranged in a row. These embroidery locations 1 are provided with displaceably guided embroidery needles 2 as is well known in this technology. The associated embroidery threads or yarns 3, appropriately acted upon by such embroidery needles 2, are guided over a thread delivery or feed device 4 so that these embroidery threads 3 or the like are arranged adjacent one another and such thread delivery device 4 serves to accomplish, during the embroidering operation, the required thread feed or advance and thread withdrawal or retraction, as the case may be.

As to such thread delivery or feed device 4 which is well known in the art, it will be seen that such here comprises two substantially rod-shaped thread guides or guide members **6*a* and 6*b* which extend over the entire width of the embroidering machine. These thread guides or guide members 6*a* and 6*b* are drivingly supported to accomplish conjoint to-and-fro oscillatory or rocking motions at associated conventional drive shafts, and such to-and-fro oscillatory or rocking motions have been conveniently indicated in FIG. 1 by the double-headed arrows 5*a* and 5*b*, respectively. These thread guides or guide members 6a or 6b are partially trained or wrapped by the embroidery threads or yarns 3 or the like which are operatively associated with the individual embroidery locations or positions 1, as the same has been clearly shown in FIG. 1. These embroidery threads 3 or the like are guided, as likewise shown in FIG. 1, over a thread brake device, here shown, for instance, as a thread brake roll or roller 33**.

As to the foregoing construction of the embroidery machine such is well known in the embroidery art, so that no further detailed description thereof is believed to be necessary or warranted, particularly since the same is not furthermore necessary to understand the underlying principles and concepts of the present development.

In order to be able to effectively limit at such embroidery machine, on the one hand, the aforementioned lateral shifting or displacements of the embroidery threads 3 upon the thread guides or guide members 6a and 6b and, on the other hand, to achieve a suitable clamping or fixed retention of the embroidery threads 3 which momentarily do not participate in the embroidery operation as well as a cutting of the excess lengths thereof, the invention contemplates providing a thread guide and clamping device 10 which is preferably arranged between the thread delivery device 4 and the thread brake roll or roller 33. This thread guide and clamping device 10 unites the functions of thread guiding, clamping and cutting or severing of the relevant threads 3 while affording a simple and rapid accomplishment of the drawing or pulling in of the threads into the guide structure.

Figure 2:
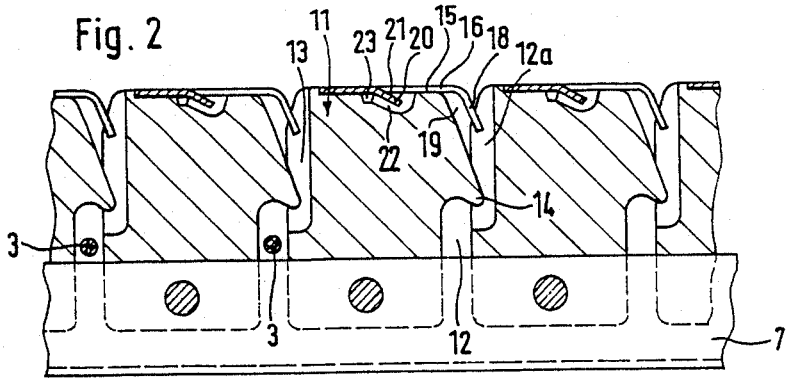
FIG. 2 is a longitudinal sectional view somewhat on an enlarged scale and in fragmentary illustration of the thread guide and clamping device composed of guide elements or pieces and constructed according to a first exemplary embodiment of the invention.

This thread guide and clamping device 10 will be seen to comprise a number of substantially block-shaped or quadrangular guide elements or pieces 11 corresponding in number to the number of embroidery locations or positions 1. These guide elements 11 are arranged adjacent one another in a row upon a machine-fixed holder or holder member, here shown as a holder rail or rail member 7 and at a pitch or spacing from one another which substantially corresponds to the smallest spacing of the embroidery needles 1 from one another. As will be evident by inspecting FIG. 1, the width of these guide elements 11 is somewhat less then the minimum spacing of the embroidery needles 1 from one another, so that between each two neighbouring guide elements 11 there is formed a thread guide gap or slot 12 for the lateral limited guiding of the inserted or laid-in thread 3 or the like. In this respect attention is also directed to FIG. 2 showing greater details of such thread guide gap or slot 12.

Each guide element 11 is provided at its one narrow side or end with a vertical recess or cutout 13 and at its other or oppositely situated narrow side or end with a nose or nose member or nose-like protuberance 14. Each such nose or nose member 14 is intended to engage into or be received in the vertical recess 13 of the neighbouring guide element 11 and protrudes into the region of the upper portion or section of the thread guide gap or slot 12. This design limits or bounds the thread guide gap or slot 12 towards the top or in upward direction and thus prevents an undesired jumping out of a thread 3 or the like which has been previously inserted into the thread guide gap or slot 12. Notwithstanding this construction the insertion or laying-in of the tensioned or stretched thread 3 from above into the thread guide gap or slot 12 can be accomplished quickly and in an extremely easy fashion, as will be evident by reverting again to FIG. 2.

Hence, there are first of all fulfilled the conditions for realizing an optimum guiding and a simple and rapid thread-in or laying-in of the relatively densely adjacently situated embroidery threads 30 or like.

Figure 3:
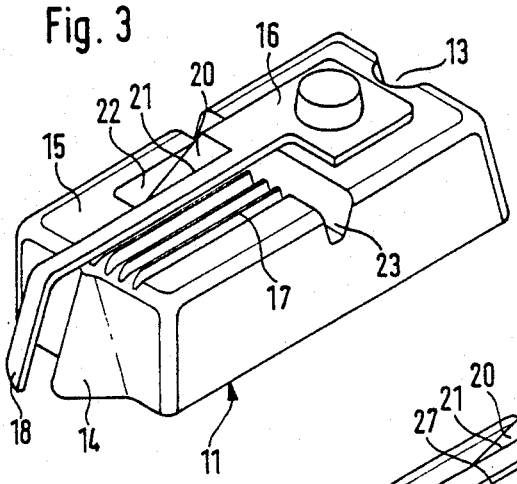
FIG. 3 is a fragmentary perspective view on an enlarged scale illustrating one of the guide elements of the thread guide and clamping device depicted in FIGS. 1 and 2.

For the embodiment depicted in FIG. 3 each guide 11 is provided at its upper surface or top face 15 with an irregular or uneven, such as a serrated clamping surface 17 in order to accomplish clamping of the free end of a stationary embroidery thread 3, in other words an embroidery thread which is not participating in the embroidery operation. This serrated clamping surface 17 or equivalent structure coacts with a resilient element, such as a thread clamping spring or spring member 16 beneath which there is drawn or inserted the embroidery thread 3 and thus the same can be positively yet, however, easily releasably fixedly clamped, as will be apparent by inspecting FIGS. 2 and 3.

Figure 4:
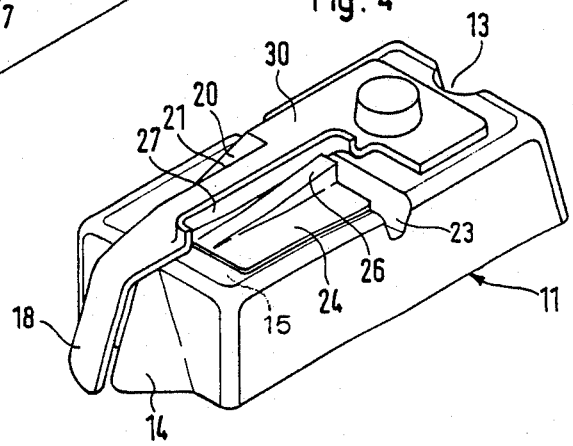
FIG. 4 is a perspective view, corresponding to the showing of FIG. 3, of a guide element according to a second embodiment of thread guide and clamping device as contemplated by the invention.
Figure 5:
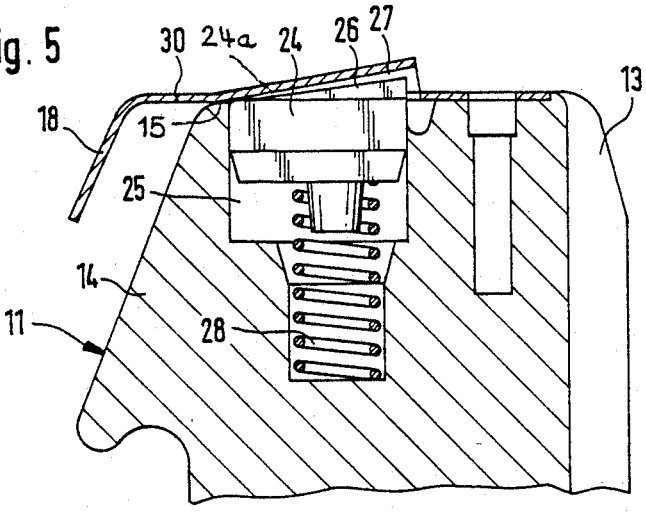
FIG. 5 is an enlarged longitudinal sectional view through the upper portion of the embodiment of guide element depicted in FIG. 4.

The modified embodiment of FIGS. 4 and 5 differs from the just described embodiment of FIGS. 2 and 3 in that in this case the clamping force is not generated by a clamping spring corresponding to the thread clamping spring 16 described above. In lieu of such thread clamping spring 16, in the alternative embodiment depicted in FIGS. 4 and 5, there is utilized a relatively stiff clamping plate or plate member 30 which coacts with a clamping element or piece 24 which resiliently contacts the clamping plate or plate member 30 at its underside or bottom surface. As will be apparent from the enlarged sectional showing of FIG. 5, the clamping element 24 is seated in an appropriately configured recess or depression 25 provided at the upper end surface or face 15 of the guide element 11 and is pressed by the action of a compression or pressure spring 28 supported at the base of this recess 25 against the lower side or face of the clamping plate 30.

Additionally, at its upper end surface or face 24a there is provided or formed at the clamping element 24 an inclined or sloped rib or rib member 26 which engages into an appropriately configured recess or pocket 27 of the clamping plate or plate member 30. The coaction of the rib member 26 and the recess or pocket 27 results in the provision of a triple or three-fold deflection of a thread end which has been drawn in for the purpose of fixedly clamping the same and thus an increase of the thread withdrawal force. This thread withdrawal force is then also sufficient for positively fixedly clamping such types of threads for which the clamping force of the somewhat simpler designed thread guide and clamping device depicted in FIG. 3 is not sufficient. Even with this modified construction the lateral drawing-in or threading of the thread end can be accomplished with equal rapidity and simplicity as for the embodiment of the thread guide and clamping device depicted and described in conjunction with FIG. 3.

In order to further facilitate the drawing or threading-in of a thread end 3a which is to be fixedly clamped and which has, for instance, been drawn back manually, as shown in FIG. 1, beneath the clamping spring 16 at the guide element depicted in FIG. 3 or beneath the clamping plate 30 at the modified construction shown in the embodiment of FIGS. 4 and 5, the guide elements 11 are preferably designed in such a manner that the gap or slot 12 between each two neighbouring guide elements 11 opens into an upwardly widening section or portion 12a. In this widened section of portion 12a as well as in the vertical recess or cut-out 13 there is received the flexed free end 18 of the clamping spring 16 or the clamping plate 30, as the case may be, in order to thus form a bent or flexed thread insertion or draw-in channel 19.

In order to simply and cleanly cut or sever the excess length of the pulled back or retracted and fixedly clamped thread end 3*a*, as recognized in the showing of FIGS. 3 and 4, there is formed at the actuation-side outer edge of the clamping spring 16 or the clamping plate 30, respectively, a somewhat downwardly flexed or sloped projection or ramp-like structure 20. The cutting edges 21 at the clamping spring 16 or the clamping plate 30, as the case may be, and the downwardly sloped projection or downwardly sloped ramp-like structure 20 function in the manner of a cutting shear. The downwardly sloped projection or downwardly sloped ramp-like structure 20 engages into an appropriately configured recess 22 at the associated guide element 11. Additionally, there is advantageously provided a blow or blow-out groove or channel 23 at the guide element 11 in order to conveniently eliminate any lint fly and thread remainders or other undesired contaminants. This blow groove or channel 23 extends directly beneath the cutting edge or cutting edge means 21.

From what has been heretofore described it will be realized that there is obtained an extremely versatile arrangement, which can be readily modified beyond the specific embodiments described heretofore while utilizing the principles and teachings of the invention, in order to realize an effective limiting of the lateral shifting or displacement of the embroidery threads or the like as well as for optimumly preparing stationary or non-participating threads for the next color and repeat change by accomplishing a readily discernible and easily releasable clamping as well as cutting-to-length of the related thread ends. Furthermore, the inventive measures enable retrofitting existing embroidery machines of the previously mentioned type in a most simple and efficacious manner.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. An embroidery machine comprising:

a plurality of axially displaceably guided embroidery needles coacting with embroidery threads;

said embroidery needles being arranged in at least one row at embroidery locations;

a thread delivery device comprising conjointly to-and-fro oscillatingly driven adjacently arranged thread guides;

said embroidery threads partially being trained about said conjointly to-and-fro oscillatingly driven adjacently arranged thread guides for selectively accomplishing a thread feed and thread retraction;

a thread guide and clamping device arranged at the region of said thread guides;

said thread guide and clamping device comprising guide elements serving for guiding of the embroidery threads, clamping of the embroidery threads and cutting of thread ends of the embroidery threads;

said guide elements corresponding in number to the number of embroidery locations;

a machine-fixed holder member; and said guide elements being arranged adjacent one another in a row along said machine-fixed holder member.

2. The embroidery machine as defined in claim 1, further including:

thread brake means; and said thread guide and clamping device being arranged between said thread guides and said thread brake means.

3. The embroidery machine as defined in claim 2, wherein:

said thread brake means comprises a thread brake roll.

4. The embroidery machine as defined in claim 1, wherein:

said machine-fixed holder member comprises a stationary holder rail.

5. The embroidery machine as defined in claim 1, wherein:

said embroidery needles are mutually spaced from one another at a predeterminate pitch;

said guide elements are mounted in mutually spaced relationship from one another to define a pitch corresponding to the smallest spacing of the embroidery needles from one another;

each of said guide elements possessing a width which is less than the predeterminate pitch of said embroidery needles; and each two neighbouring guide elements defining therebetween a thread guide slot for laterally limited guiding of an inserted embroidery thread.

6. The embroidery machine as defined in claim 5, wherein:

each of said guide elements has oppositely situated narrow sides;

one of said narrow sides of each guide element being provided with a substantially vertically extending recess;

the other oppositely situated narrow side of each of said guide elements being provided with a nose member; and said nose member of each guide element engaging into the substantially vertically extending recess of a neighbouring guide element and protruding into an upper portion of the thread guide slot.

7. The embroidery machine as defined in claim 6, wherein:

each said guide element possesses an upper side;

each said upper side possessing an irregular clamping surface; and a thread clamping spring provided at the upper side of each guide element and coacting with said irregular clamping surface of such guide element.

8. The embroidery machine as defined in claim 7, wherein:

said irregular surface comprises a serrated claimping surface.

9. The embroidery machine as defined in claim 6, wherein:

each guide element has an upper side;

a clamping plate having an underside and positined at the upper side of each guide element;

a clamping element cooperating with said clamping plate; and said clamping element resiliently bearing against the underside of said clamping plate.

10. The embroidery machine as defined in claim 9, wherein:

each guide element is provided with recess means at its upper side;

a compression spring arranged in said recess means;

said clamping element being arranged in said recess means;

said compression spring pressing said clamping element against said clamping plate;

said clamping element having an upper side provided with inclined rib means;

said clamping plate being provided with recess means; and said inclined rib means engaging into said recess means of said clamping plate.

11. The embroidery machine as defined in claim 1, wherein:

each said guide element possesses an upper side;

each said upper side possessing an irregular clamping surface;

a thread clamping spring provided at the upper side of each guide element and coacting with said irregular clamping surface of such guide element;

said embroidery needles being mutually spaced from one another at a predeterminate pitch;

said guide elements being mounted in mutually spaced relationship from one another to define a predeterminate pitch;

each of said guide elements possessing a width which is less then the predeterminate pitch of said embroidery needles;

each of said guide elements possessing a substantially vertically extending recess;

each two neighbouring guide elements defining therebetween a thread guide slot for laterally limited guiding of an inserted embroidery thread;

said thread clamping spring having a flexed free end;

each said guide element containing a thread draw-in channel for the thread;

each said thread guide slot having an upwardly widening portion; and each said flexed free end of the thread clamping spring engaging into the upwardly widening section of the thread guide slot between two neighbouring guide elements and into said substantially vertically extending recess in order to limit the thread draw-in channel.

12. The embroidery machine as defined in claim 11, wherein:

said thread clamping spring has an outer edge;

a downwardly sloped projection provided at said outer edge of the thread clamping spring; and cutting edge means provided at the thread clamping spring and said downwardly sloped projection and serving as thread cutting means.

13. The embroidery machine as defined in claim 12, wherein:

each said guide element comprises a blow groove means extending directly beneath said cutting edge means.

14. The embroidery machine as defined in claim 1, wherein:

each said guide element possesses an upper side;

each said upper side possessing an irregular clamping surface;

a thread clamping plate provided at the upper side of each guide element and coacting with said irregular clamping surface of such guide element;

said embroidery needles being mutually spaced from one another at a predterminate pitch;

said guide elements being mounted in mutually spaced relationship from one another to define a pitch;

each of said guide elements possessing a width which is less then the predeterminate pitch of said embroidery needles;

each of said guide elements possessing a substantially vertically extending recess;

each two neighbouring guide elements defining therebetween a thread guide slot for laterally limited guiding of an inserted embroidery thread;

said thread clamping plate having a flexed free end;

each said guide element containing a thread draw-in channel for the thread;

each said thread guide slot having an upwardly widening portion; and each said flexed free end of the thread clamping plate engaging into the upwardly widening section of the thread guide slot between two neighbouring guide elements and into said substantially vertically extending recess in order to limit the thread draw-in channel.

15. The embroidery machine as defined in claim 14, wherein:

said thread clamping plate has an outer edge;

a downwardly sloped projection provided at said outer edge of the thread clamping plate; and cutting edge means provided at the clamping plate and said downwardly sloped projection and serving as thread cutting means.

16. The embroidery machine as defined in claim 15, wherein:

each said guide element comprises a blow groove means extending directly beneath said cutting edge means.

* * * * *